US007380535B2

(12) United States Patent
Hartmann et al.

(10) Patent No.: US 7,380,535 B2
(45) Date of Patent: Jun. 3, 2008

(54) METHOD AND DEVICE FOR OPERATING AN INTERNAL COMBUSTION ENGINE HAVING MULTIPLE CYLINDERS

(75) Inventors: Dirk Hartmann, Stuttgart (DE); Werner Mezger, Eberstadt (DE); Oliver Krannich, Tamm (DE); Ingo Fecht, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/592,818

(22) Filed: Nov. 2, 2006

(65) Prior Publication Data

US 2007/0113820 A1 May 24, 2007

(30) Foreign Application Priority Data

Nov. 2, 2005 (DE) ..... 10 2005 052 259

(51) Int. Cl.

| | |
|---|---|
| ***F02D 13/06*** | (2006.01) |
| ***F02D 17/02*** | (2006.01) |
| ***F02M 63/02*** | (2006.01) |
| ***F01L 1/34*** | (2006.01) |

(52) U.S. Cl. ..... 123/198 F; 123/90.15; 123/481; 123/198 DB

(58) Field of Classification Search ..... 123/347, 123/348, 90.15–90.18, 198 DB, 198 F, 481; 701/104, 105, 112

See application file for complete search history.

(56) References Cited

U.S. PATENT DOCUMENTS

| | | | | |
|---|---|---|---|---|
| 3,570,462 | A * | 3/1971 | Hauk | 123/547 |
| 4,284,042 | A * | 8/1981 | Springer | 123/198 F |
| 4,909,195 | A * | 3/1990 | Hasebe et al. | 123/90.16 |
| 5,394,841 | A * | 3/1995 | Murakami | 123/90.15 |
| 6,487,998 | B1 * | 12/2002 | Masberg et al. | 123/192.1 |
| 6,688,275 | B2 * | 2/2004 | Shindou et al. | 123/198 F |
| 6,694,246 | B2 * | 2/2004 | Masuda et al. | 701/114 |
| 6,752,121 | B2 * | 6/2004 | Rayl et al. | 123/198 F |
| 6,830,536 | B2 * | 12/2004 | Tanaka et al. | 477/110 |
| 6,988,481 | B2 * | 1/2006 | Sen et al. | 123/198 F |
| 2007/0089709 | A1 * | 4/2007 | Hartmann et al. | 123/90.16 |

FOREIGN PATENT DOCUMENTS

| | | |
|---|---|---|
| JP | 2002004898 | 1/2002 |

* cited by examiner

*Primary Examiner*—Willis R Wolfe, Jr.
(74) *Attorney, Agent, or Firm*—Kenyon & Kenyon LLP

(57) ABSTRACT

A method and a device for operating an internal combustion engine having multiple cylinders allows for an operating state of the internal combustion engine to be switched over as quickly as possible following the receipt of a switchover request. For this purpose, at least one intake or exhaust valve of a cylinder is switched off or at least one switched-off intake or exhaust valve of the cylinder is switched on again in at least one operating state of the internal combustion engine in response to the switchover request.

7 Claims, 5 Drawing Sheets

METHOD AND DEVICE FOR OPERATING AN INTERNAL COMBUSTION ENGINE HAVING MULTIPLE CYLINDERS

CROSS-REFERENCE TO RELATED APPLICATIONS

The present application claims priority to Application No. 10 2005 052 259.9, filed in the Federal Republic of Germany on Nov. 2, 2005, which is expressly incorporated herein in its entirety by reference thereto.

BACKGROUND INFORMATION

The present invention relates to a method and a device for operating an internal combustion engine having multiple cylinders.

BACKGROUND INFORMATION

In so-called half engine operation, half of the cylinders of the internal combustion engine do not participate in the combustion process by having their intake and exhaust valves as well as their fuel injection switched off, which compared to full engine operation, in which the intake and exhaust valves as well as the fuel injection of all cylinders are activated, allows for fuel savings. The intake and exhaust valves are generally also referred to as gas-exchange valves. The times at which the gas-exchange valves may be deactivated or activated are limited by the base circle of the camshaft operating the respective gas-exchange valve, since the corresponding gas-exchange valve is in the powerless rest state only on the base circle of the camshaft. Half engine operation is possible only in a limited operating range of the internal combustion engine. FIG. 2 shows the operating range of half engine operation shaded in a diagram of the engine torque Md plotted against the engine speed nmot. Half engine operation is accordingly possible only in an operating range in which for engine speed nmot: nmot1≦nmot≦nmot2. Furthermore, half engine operation is possible only in an operating range of the internal combustion engine, in which for engine torque Md of the internal combustion engine: 0 ≦Md ≦Md1. In this instance, nmot1 represents a first engine speed threshold, nmot2 a second engine speed threshold and Md1 an engine torque threshold. Within the operating range limited by the mentioned threshold values as represented in a shaded manner in FIG. 2, the internal combustion engine may be operated in half engine operation, outside of this operating range in full engine operation. In a transition of the operating state of the internal combustion engine from the operating range of full engine operation into the operating range of half engine operation shown in a shaded manner in FIG. 2, a switchover request is produced, in response to which the intake and exhaust valves of half of the cylinders are switched off and the fuel supply associated with these cylinders is deactivated. If conversely a transition is made from the operating range of half engine operation into the operating range of full engine operation, then a switchover request is produced, in response to which all of the switched-off intake and exhaust valves are switched on again and the fuel supply associated with the corresponding cylinders is activated again.

SUMMARY

By contrast, a method according to example embodiments of the present invention and a device according example embodiments of the present invention for operating an internal combustion engine having multiple cylinders may provide that, with the receipt of the switchover request, a delay time or a delay crank angle is ascertained, which is required for switching off or switching on again the at least one intake or exhaust valve of one of the cylinders, that, starting from the time or the crank angle of the receipt of the switchover request and by taking into account the ascertained delay time or the ascertained delay crank angle, the cylinder is selected whose at least one exhaust valve, following the expiration of the delay time or of the delay crank angle starting from the time or crank angle of the receipt of the switchover request, is the next to open in the switched-on state or would be the next to open, though it is switched off, and that this cylinder is ascertained as the one whose at least one intake or exhaust valves are designated as the first to be switched off or switched on again following the receipt of the switchover request. In this manner, it may be particularly easy, even in the case of an adjustable intake/exhaust camshaft, to ascertain the cylinder which is the first to be able to participate, following the arrival of the switchover request, in a new operating mode of the internal combustion engine, for example, half engine operation or full engine operation. Thus it is possible, as soon as the operating conditions are fulfilled, to carry out in a quickest possible manner a changeover, for example, from full engine operation to half engine operation or from half engine operation to full engine operation following the arrival of a corresponding switchover request.

In addition to the ascertained delay time or the ascertained delay crank angle, a safety interval may be ascertained, which should lie between the end of the delay time or of the delay crank angle and the time or crank angle for the potential opening of the at least one exhaust valve of one of the cylinders whose at least one intake or exhaust valve is designated to be switched off or switched on again, and that, starting from the time or crank angle of the receipt of the switchover request and taking into account the ascertained delay time or the ascertained delay crank angle and the ascertained safety interval, the cylinder is selected whose at least one exhaust valve, following the expiration of the delay time or of the delay crank angle and of the safety interval starting from the time or crank angle of the receipt of the switchover request, is the next to open in the switched-on state or is the next that would open, though it is switched off, and that this cylinder is ascertained as the one whose at least one intake or exhaust valve is designated to be the first to be switched off or switched on again following the receipt of the switchover request. In this manner, with the aid of the safety interval, it is possible to minimize instances of faulty switching of the at least one intake or exhaust valve, which may result in potential damage to the at least one intake or exhaust valve or its switching mechanism.

The selected cylinder may be ascertained as the one whose at least one intake or exhaust valve is designated to be the first to be switched off or switched on again following the receipt of the switchover request only if it is provided for or capable of having its at least one intake or exhaust valve switched off or switched on again. This provides that, even in the case in which not all cylinders are enabled for or capable of having their at least one intake or exhaust valve switched off or switched on again, a switchover may be possible in a fastest possible manner between different operating modes of the internal combustion engine, which differ in the number of cylinders having at least one intake or exhaust valve switched on, that is, for example, in half engine operation or in full engine operation, in response to a corresponding switchover request.

At least one intake or exhaust valve may be switched off or switched on again in multiple cylinders and if on the basis of the selected cylinder at least one additional cylinder is designated to be switched off or switched on again, which in a firing sequence is set apart by at least one even number from the selected cylinder. In this manner, even for switching off or switching on again at least one intake or exhaust valve of multiple cylinders, only the cylinder needs to be ascertained whose at least one intake or exhaust valve is the first to be switched off or switched on again following receipt of the switchover request. In this manner, the effort for ascertaining the cylinders, whose at least one intake or exhaust valve is to be switched off or switched on again, is no greater than the effort required for selecting only one cylinder whose at least one intake or exhaust valve is to be switched off or switched on again.

Starting from the time or starting from the crank angle of the receipt of the switchover request and taking into account the ascertained delay time or the ascertained delay crank angle ascertained next time or crank angle for the potential opening of the at least one exhaust valve of the selected cylinder, its subsequent upper ignition dead center is ascertained and a check is performed as to which segment of a cylinder counter this upper ignition dead center is assigned, and if the selected cylinder is identified on the basis of the thus determined segment of the cylinder counter. In this manner it is possible to ascertain in a particularly simple manner the number of the cylinder whose at least one intake or exhaust valve is designated to be the first to be switched off or switched on again following the receipt of the switchover request and thus to perform a particularly simple identification of this cylinder. This identification is also particularly reliable such that a misidentification is prevented and thus an unintentional delay in the implementation of the switchover request is prevented.

The ascertained delay time or the ascertained delay crank angle may include a mechanical delay time or a mechanical delay crank angle, and the switching off or switching on again of the at least one intake or exhaust valve of the selected cylinder may be delayed by a start time or start crank angle with respect to the time or crank angle of the receipt of the switchover request in order to position the mechanical delay time or the mechanical delay crank angle centrally in a switching window between a time or crank angle for the potential opening of at least one intake valve and a time or crank angle for the potential opening of at least one exhaust valve of the selected cylinder. In this manner, it is possible to maximize the upper engine speed limit at which it is possible without damage to switch off or switch on again the at least one intake or exhaust valve. In the example illustrated in FIG. 2 this means that the second engine speed threshold nmot2 for switching over from half engine operation into full engine operation or from full engine operation into half engine operation may be maximized.

Exemplary embodiments of the present invention are described in more detail below with reference to the appended Figures.

DETAILED DESCRIPTION

Figure 1:
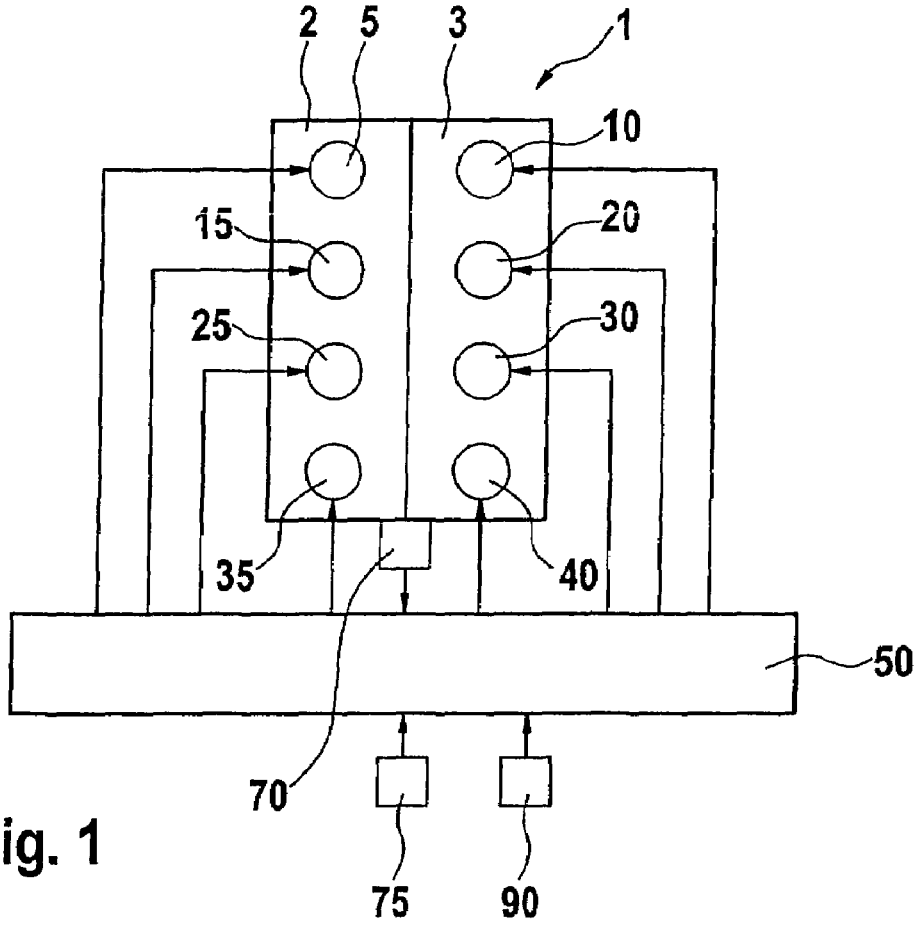
FIG. 1 is a block diagram of an internal combustion engine.

Reference numeral 1 in FIG. 1 denotes an internal combustion engine, which takes the form of a spark-ignition engine or a diesel engine, for example, and drives a vehicle, for example. In the present example, internal combustion engine 1 includes a first cylinder bank 2 and a second cylinder bank 3 having each four cylinders in this example. In the present context, it should be assumed in the following by way of example that internal combustion engine 1 takes the form of a spark-ignition engine. In this instance, alternately one cylinder of first cylinder bank 2 and one cylinder of second cylinder bank 3 are ignited such that in the firing sequence a first cylinder 5, a third cylinder 15, a fifth cylinder 25 and a seventh cylinder 35 are arranged in first cylinder bank 7 and a second cylinder 10, a fourth cylinder 20, a sixth cylinder 30 and an eighth cylinder 40 are arranged in the second cylinder bank 30. Each of the cylinders in this instance includes at least one intake valve and at least one exhaust valve. The at least one intake valve and the at least one exhaust valve of each cylinder is in each case driven by a common camshaft or by a separate intake camshaft and a separate exhaust camshaft. For this purpose, each cylinder may have assigned to it a intake and/or exhaust camshaft of its own. It is also possible for multiple cylinders, e.g., two, to share in each case one intake and/or in each case one exhaust camshaft and thus to have a common synchronous valve timing. In the event that multiple cylinders share a common intake camshaft and/or a common exhaust camshaft, there may be a provision for the intake camshaft and the exhaust camshaft to be identical such that for multiple cylinders exactly one camshaft exists both for controlling the intake valves as well as for controlling the exhaust valves. Alternatively and as indicated in FIG. 1, a fully variable valve timing is also possible, in which each individual gas-exchange valve, that is, each individual intake and/or exhaust valve is triggered individually with respect to its opening and its closing time by an engine control unit 50. Opening and closing times of the individual gas-exchange valves are in this instance known in engine control unit 50. In the region of the two cylinder banks 2, 3, a crank angle sensor 70 is arranged, which detects the current crank angle of internal combustion engine 1 and transmits the measured value to engine control unit 50. Additionally, a load sensor 75 is provided, which detects a variable influencing the engine load, such as for example the air mass flow supplied to the internal combustion engine, and transmits the measured value to engine control unit 50. In, e.g., a conventional manner, engine control unit 50 ascertains from the detected air mass flow and the engine speed nmot derived from the detected crank angle the combustion chamber charge of internal combustion engine 1 as a signal characterizing the load of internal combustion engine 1. Furthermore, a temperature sensor 90 is provided, which measures an engine oil temperature and transmits the measured values to engine control unit 50. For this purpose, all sensors 70, 75, 90 respectively ascertain the current value of the variable detected by them and transmit it to engine control unit 50. Sensor 75, for example, may be configured as an air mass meter, e.g., as a hot film air mass meter.

Figure 2:
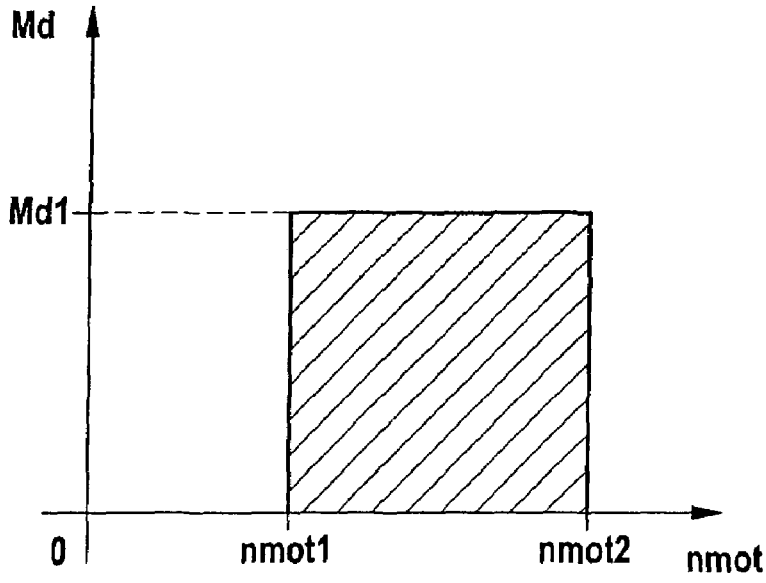
FIG. 2 is a diagram of an engine torque plotted against an engine speed for illustrating the operating range of the internal combustion engine for a half engine operation and the operating range of the internal combustion engine for a full engine operation.
Figure 3:
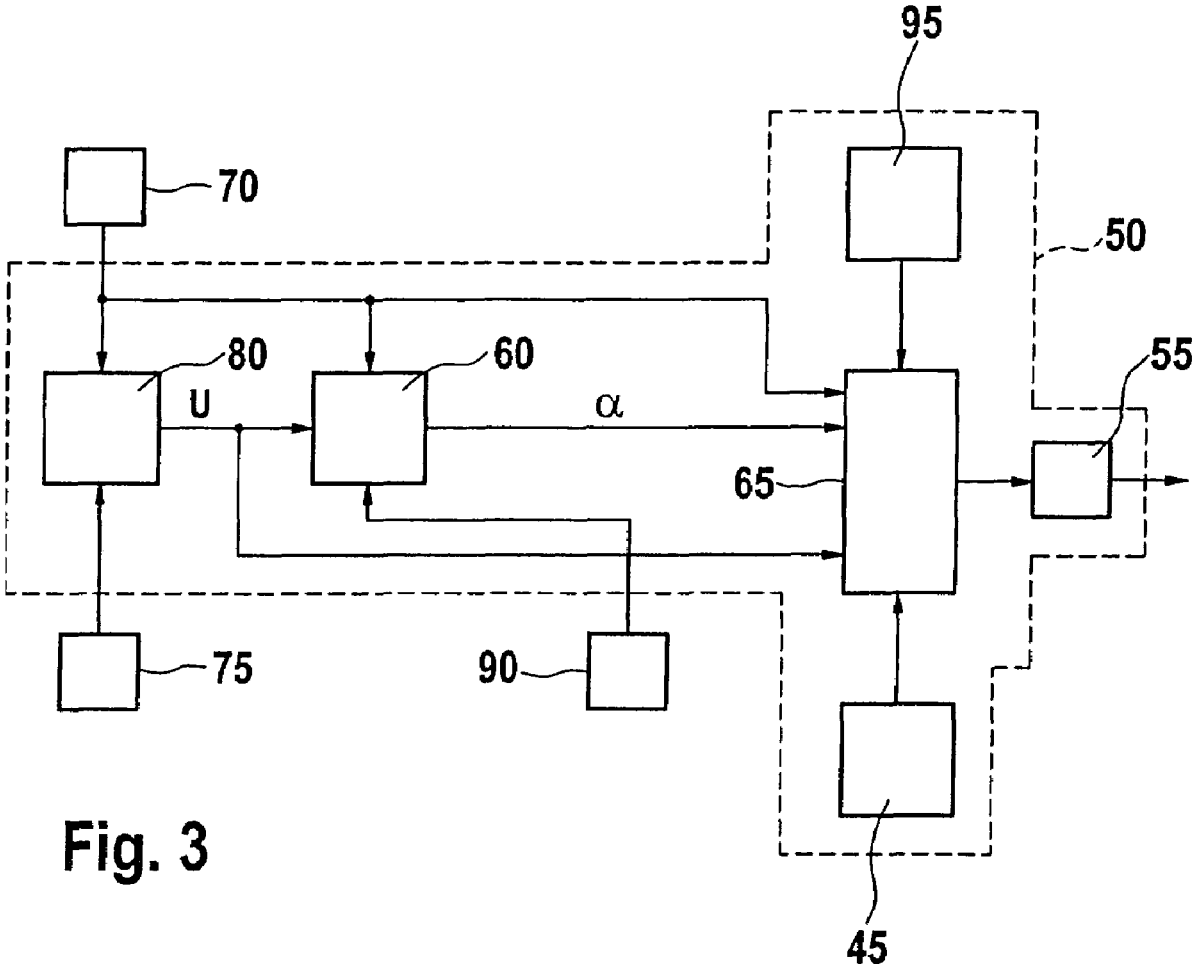
FIG. 3 is a flow chart for explaining a device according to example embodiments of the present invention and a method according to example embodiments of the present invention.
Figure 5:
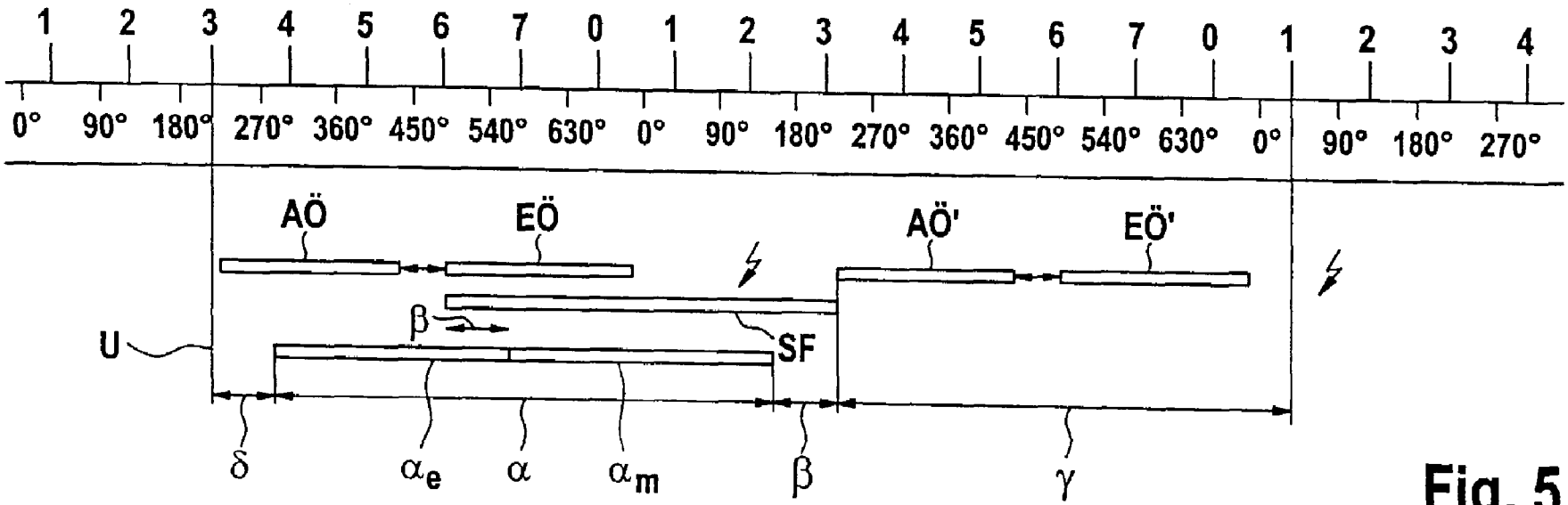
FIG. 5 is a diagram for illustrating the valve timing and the possible switching time for switching off or switching on again at least one intake or exhaust valve of a cylinder.
Figure 6:
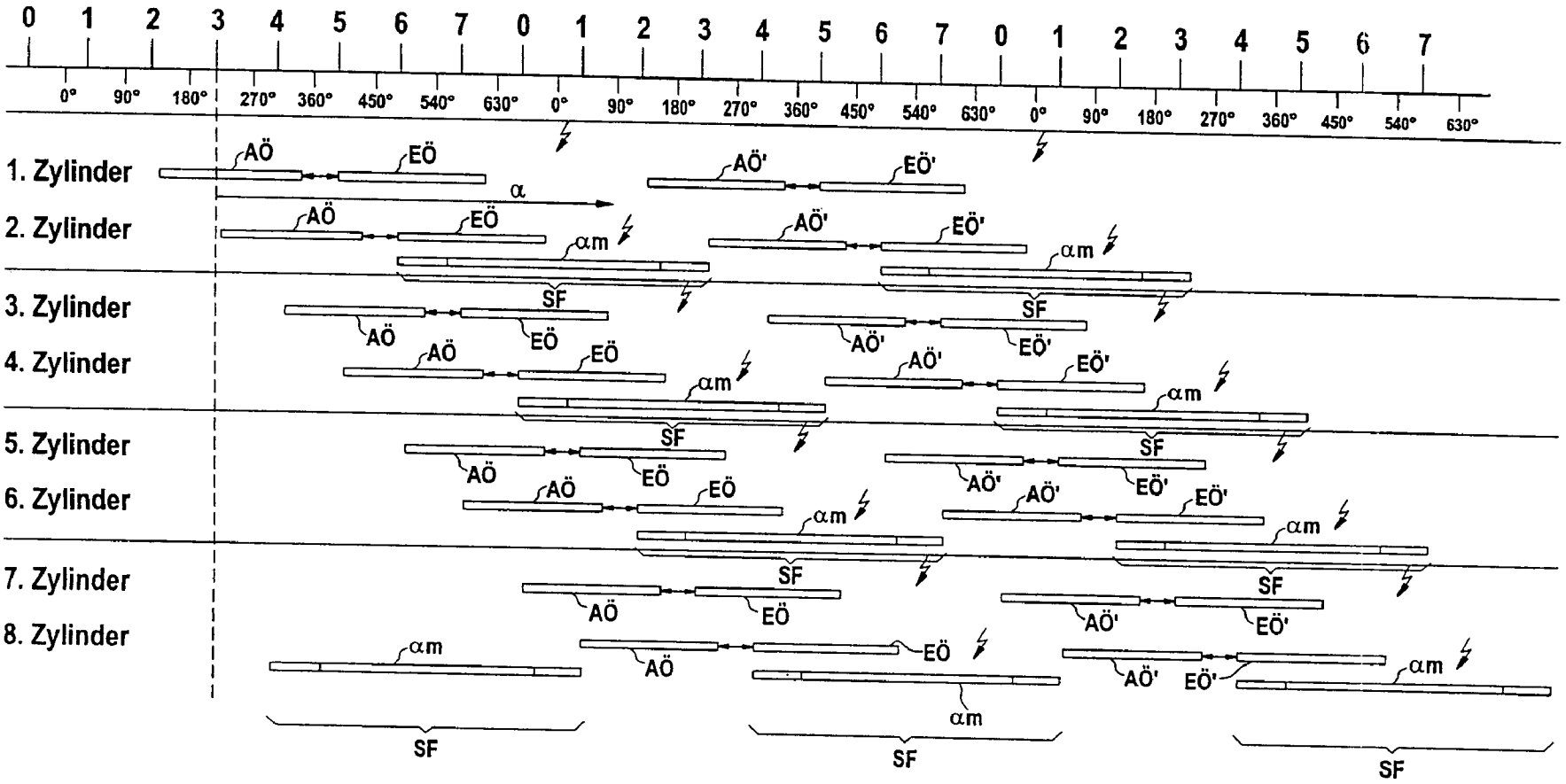
FIG. 6 illustrates the valve timing and the possible switching times for switching off or switching on again at least one intake or exhaust valve of a cylinder for an eight-cylinder engine.

A trigger function is implemented in software and/or hardware in engine control unit 50, as is shown in an exemplary fashion in the flow chart in FIG. 3. In this connection, an evaluation unit 80 is provided, which is supplied with the signal of air mass sensor 75 and the signal of crank angle sensor 70. From the time sequence of the crank angles received from crank angle sensor 70, evaluation unit 80 forms engine speed nmot by differentiation. Evaluation unit 80 forms the charge of combustion chamber 1 from the signal of air mass sensor 75 and engine speed nmot. From the current charge and the current engine speed nmot, evaluation unit 80 forms the current engine torque Md of internal combustion engine 1, e.g., in a conventional manner, for example with the aid of a characteristics map applied on a test stand. According to the diagram in FIG. 2, evaluation unit 80 checks whether internal combustion engine 1 is in the operating range of full engine operation or in the operating range of half engine operation or whether a transition is possible from half engine operation into full engine operation or from full engine operation into half engine operation. In this case, a switchover request U is produced by evaluation unit 80 and is transmitted to an ascertainment unit 60. Ascertainment unit 60 is supplied with the signal of temperature sensor 90. Ascertainment unit 60 is further supplied with the signal of crank angle sensor 70, from which ascertainment unit 60 ascertains engine speed nmot by differentiation. With the receipt of switchover request U, ascertainment unit 60 ascertains a delay time or a delay crank angle, which is required for switching off or switching on again the at least one intake or exhaust valve of one of cylinders 5, 10, 15, 20, 25, 30, 35, 40 of internal combustion engine 1. This delay time or this delay crank angle includes a mechanical delay time or a mechanical delay crank angle which is dependent on engine speed nmot and the engine oil temperature. Furthermore, the delay time or the delay crank angle includes an electrical delay time or an electrical delay crank angle which is dependent on the engine oil temperature and the voltage supply, i.e., the electrical system voltage. The electrical system voltage is communicated to ascertainment unit 60 either by a device or is known to ascertainment unit 60 by the fact that it is supplied by the voltage supply with the electrical system voltage and knows the electrical system voltage in this manner. The description is continued in the following for example at the level of the crank angle, it being possible to perform the conversion between crank angle and time using the engine speed, e.g., in a conventional manner. Thus a total delay crank angle $\alpha$ is obtained as the sum of the electrical delay crank angle $\alpha_e$ and the mechanical delay crank angle $\alpha_m$. The total delay crank angle $\alpha$ is thus the crank angle which elapses from the start of supplying power to an adjusting element for switching off or switching on again the at least one intake or exhaust valve of a cylinder until a mechanical adjusting unit has switched off or switched on again the at least one intake or exhaust valve. Ascertainment unit 60 thus ascertains in the manner described the total delay crank angle $\alpha$ and relays this to a selection unit 65. Selection unit 65 is additionally supplied with switchover request U and by crank angle sensor 70 with the crank angle signal. On the basis of the crank angle of the receipt of switchover request U and taking into account ascertained total delay crank angle $\alpha$, selection unit 65 selects the cylinder 5, 10, 15, 20, 25, 30, 35, 40 of internal combustion engine 1, whose at least one exhaust valve, following the expiration of the total delay crank angle $\alpha$ starting from the crank angle of the receipt of switchover request U, is the next to open in the switched-on state or would be the next to open, though it is switched off. Furthermore, a valve timing 95 is provided, which communicates the current valve timing of all cylinders 5, . . . , 40 of internal combustion engine 1 to selection unit 65. These are shown in FIG. 6 by way of example. Furthermore, a cylinder counter 45 is provided, which periodically divides the crank angles into segments, each segment being assigned to one cylinder in the firing sequence and thus, in the case of the eight-cylinder engine described by way of example, eight segments resulting over a crank angle interval of 720°, which repeat periodically and which are numbered in FIG. 6 from 0 through 7. Cylinder counter 45 is connected to selection unit 65. As described, selection unit 65 thus checks which cylinder starting from the crank angle of the receipt of switchover request U following the expiration of the ascertained total delay crank angle $\alpha$ in the switched-on state is next to open its at least one exhaust valve or would be next to open its at least one exhaust valve, though it is switched off. This cylinder is selected by selection unit 65 and is subsequently identified on the basis of the information received from valve timing 95 and cylinder counter 45 in selection unit 65 as a number in the firing sequence. This is done in that selection unit 65 checks on the basis of the information of valve timing 95, i.e., of the valve timing received from there, at what crank angle the selected cylinder has its upper ignition dead center. As shown in FIG. 5, this upper ignition dead center lies respectively in the segment of cylinder counter 45 following the closing time of the at least one intake valve of the selected cylinder. The number assigned to this segment is thus the number of the selected cylinder in the firing sequence. Selection unit 65 causes a switching unit 55 to switch off or switch on again the at least one intake or exhaust valve of the thus identified cylinder by taking into account the ascertained total delay crank angle $\alpha$ such that the ascertained mechanical delay crank angle lies centered in a switching window between the start of the opening of the at least one intake valve of the identified cylinder and the subsequent start of the opening of the at least one exhaust valve of the identified cylinder. Switching unit 55 thus causes the initiation of the switching off or switching on again of the at least one intake or exhaust valve of the identified cylinder delayed by one start crank angle with respect to the crank angle of the receipt of switching request U, as shown in FIG. 5, in order to place the mechanical delay crank angle centered into the described switching window.

FIG. 5 shows the second cylinder 10 in the firing sequence, which bears the number 1. At a crank angle of approximately 200°, at which the segment of the fourth cylinder of the firing sequence bearing the number 3 starts, switchover request U is received. Shortly afterward begins the opening phase of the exhaust valve of the considered second cylinder 10, which is labeled AÖ. After the exhaust valve of the considered second cylinder 10 has been closed again, the intake valve opens during the phase indicated by EÖ. After the intake valve has closed again, then the upper ignition dead center indicated in FIG. 5 by a lightening bolt arrow is reached at approximately 90° crank angle in the segment of second cylinder 10 and thus in the segment of cylinder counter 45 indicated by the number 1. Subsequently, an opening phase of the exhaust valve of the considered second cylinder 10 begins again, which is indicated in FIG. 5 by AÖ', and which is followed after its termination by a fresh opening phase of the intake valve, which is indicated by EÖ'. Subsequently, the upper ignition dead center of second cylinder 10 occurs again at 90° crank angle, as indicated in FIG. 5 by another lightening bolt arrow. The current valve timing for opening exhaust valve AÖ, AÖ' and for opening intake valve EÖ, EÖ' is known in valve timing unit 95. Following the receipt of switchover request U, ascertainment unit 60 ascertains in the manner described the mechanical delay crank angle $\alpha_m$ as it is shown in FIG. 5 as well as the electrical delay crank angle $\alpha_e$ as it is shown in FIG. 5. The sum $\alpha_e + \alpha_m$ am yields the total delay crank angle $\alpha$, as it is indicated in FIG. 5. Selection unit 65 now applies the ascertained total delay crank angle $\alpha$ directly to the crank angle at which switchover request U is received, that is, without taking into account the crank angle $\delta$ shown in FIG. 5, and checks which cylinder following the expiration of the ascertained total delay crank angle $\alpha$ is the next in the switched-on state to open its at least one exhaust valve or would open its at least one exhaust valve, though it is switched off. In the present example shown in FIG. 6, in which, in addition to the current valve timing of second cylinder 10 of the firing sequence, already shown in FIG. 5, also the current valve timing of the other cylinders of internal combustion engine 1 are entered, the result is that starting from the crank angle at which switchover request U is received plus the ascertained total delay crank angle 60 the exhaust valve of the first cylinder having the number 0 in the firing sequence is the next to open. In FIG. 6, the same designations indicate the same elements as in FIG. 5. Accordingly, following the receipt of switchover request U, first the first cylinder 5 in the firing sequence would have to be switched off or switched on again with respect to its at least one intake or exhaust valve. In the present example, however, first cylinder 5 is to be blocked from switching off or switching on again its at least one intake or exhaust valve or is to be incapable of doing so. The cylinder whose at least one intake or exhaust valve is provided to be switched off or switched on again and whose at least one exhaust valve following the expiration of the ascertained total delay crank angle $\alpha$ starting from the crank angle of the receipt of switchover request U is the next to open is, according to FIG. 6, second cylinder 10 bearing the number 1 in the firing sequence. This second cylinder 10 is selected by selection unit 65, but is initially not yet identified with respect to its cylinder number in the firing sequence. The information regarding which cylinder or cylinders is are provided for or blocked from switching on or switching off again their at least one intake or exhaust valve is communicated to selection unit 65 by valve timing 95. The identification of the cylinder number of the selected cylinder by selection unit 65 not proceeds as follows: starting from the time of the start of phase AÖ' of the opening or potential opening of the at least one exhaust valve of the selected cylinder, a subsequent reference crank angle is sought, at which cylinder counter 45 changes its segment number for the final time prior to the upper ignition dead center of the selected cylinder. The crank angle from the start of opening phase AÖ' until this reference point is indicated in FIG. 5 by y. The new cylinder number assigned to the reference crank angle following the described change of the segment number is then the cylinder number of the selected cylinder in the ignition sequence, in the present example this being the number 1, such that the selected cylinder is identified as the second cylinder 10 in the firing sequence. Selection unit 65 now ascertains a switching window SF in which the at least one intake or exhaust valve of the selected second cylinder 10 may be switched off or switched on again. As shown in FIG. 5, this is the case from the start of the phase of the opened intake valve EÖuntil the start of the subsequent phase of the opened exhaust valve AÖ'. Switching unit 55 places the mechanical delay crank angle $\alpha_m$ centered into switching window SF such that from the end of the ascertained mechanical delay crank angle $\alpha_m$ until the start of phase AÖ' of the opened exhaust valve a safety crank angle $\beta$ results, which in quantitative terms may also exist between the start of mechanical delay crank angle $\alpha_m$ and the start of phase EÖ of the opened intake valve. Switching unit 55 precedes the mechanical delay crank angle $\alpha_m$ with the ascertained electrical delay crank angle $\alpha_e$. Thus remaining in quantitative terms from the start of electrical delay crank angle $\alpha_e$ until the crank angle at which switchover request U has been received is crank angle $\delta$, which thus represents the start crank angle, delayed by which with respect to the crank angle of the receipt of the switchover request U, the switching off or switching on again of the at least one intake or exhaust valve of the selected second cylinder 10 is initiated by an appropriate electrical triggering and thus by a supply of power to the adjusting unit provided for switching off or switching back on again the at least one intake or exhaust valve. Following the switching off or switching back on again of the at least one intake or exhaust valve of the second cylinder 10, optionally those cylinders that are set apart from second cylinder 10 in the firing sequence by at least one even number may then also be switched off or switched on again with respect to their at least one intake or exhaust valve. According to FIG. 6, in addition to the second cylinder 10, the fourth cylinder 20, the sixth cylinder 30 and the eighth cylinder 40, that is, the cylinders having numbers 3, 5 and 7 in the firing sequence are switched off as well. The other cylinders, whose at least one intake or exhaust valve is to be switched off or switched on again, may thus, starting from second cylinder 10, be identified simply by the fact that they are set apart in the firing sequence from the selected cylinder, here the second cylinder 10, by an even number, for example by successive multiples of the number two. The respective start crank angle for initiating the switching off or switching on again of the at least one intake or exhaust valve of these additional cylinders may then be ascertained for the additional cylinders simply by adding to start crank angle $\delta$ for the second cylinder 10 in each case the crank angle by which the respective cylinder to be switched is set apart from second cylinder 10 with respect to its ignition interval. Thus the start crank angle for fourth cylinder 20, for example, is shifted to retard by 180° crank angle with respect to start crank angle $\delta$, because the valve timings of the fourth cylinder are also shifted to retard by 180° crank angle with respect to the valve timings of second cylinder 10. Accordingly, the start crank angle for switching off or switching on again the at least one intake or exhaust valve of the sixth cylinder 30 is shifted to retard by 360° and the start crank angle for switching off or switching on again the at least one intake or exhaust valve of the eighth cylinder 40 is shifted to retard by 540° with respect to the start crank angle $\delta$.

Instead of the same delay $\delta$ for the subsequent cylinders, $\alpha_e$ und $\alpha_m$ may also be calculated anew every two segments. Then $\delta$ will also be updated particularly as a function of a change in the engine speed.

Figure 4:
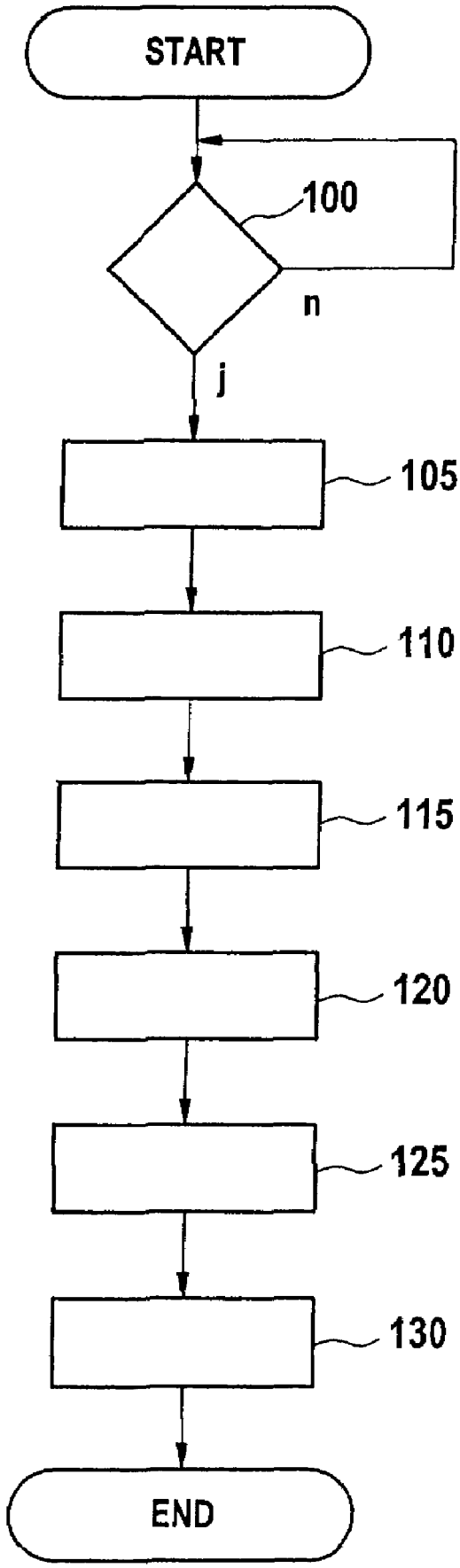
FIG. 4 is a flow chart for an exemplary sequence of a method according to an example embodiment of the present invention.

FIG. 4 shows a flow diagram of an exemplary sequence of a method according to an example embodiment of the present invention. Following the start of the program, evaluation unit 80 checks whether a switchover request U was received. If this is the case, then the system branches to a program point 105. Otherwise the system branches back to program point 100.

At program point 105, ascertainment unit 60 ascertains the total delay crank angle $\alpha$ in the manner described. The system subsequently branches to a program point 110.

By taking into account the phase adjustment of the intake and/or exhaust camshaft, at program point 110, selection unit 65 ascertains in the described manner the cylinder whose at least one intake or exhaust valve is the next to be switched off or switched on again. The system subsequently branches to a program point 115.

At program point 115, selection unit 65 ascertains the reference crank angle and in this manner assigns the associated number of the firing sequence to the selected cylinder such that the selected cylinder is identified. The system subsequently branches to a program point 120.

At program point 120, selection unit 65 ascertains switching window SF in the manner described. The system subsequently branches to a program point 125.

At program point 125, switching unit 55 places the mechanical delay crank angle ascertained by ascertainment unit 60 centrally into the ascertained switching window SF and prepends the electrical delay crank angle $\alpha_e$, which is ascertained by ascertainment unit 60, in order thus to obtain start crank angle $\delta$. The system subsequently branches to a program point 130.

At program point 130, starting from the crank angle at which switchover request U was received, following the expiration of start crank angle $\delta$, switching unit 55 prompts the initiation of the electrical triggering for switching off or switching on again the at least one intake or exhaust valve of the selected cylinder. The program is then ended.

If the ascertained mechanical delay crank angle $\alpha_m$ is greater than or equal to switching window SF, then a switching off or switching on again of the at least one intake or exhaust valve of a selected cylinder is prevented or blocked because otherwise there is the danger of damaging or destroying the mechanical adjusting unit for switching off or switching on again the at least one intake or exhaust valve or the switching off or switching on again will not be successful. Furthermore, when selecting the cylinder whose at least one intake or exhaust valve is to be the first to be switched off or switched on again following the receipt of switchover request U, it may be alternatively provided for selection unit 65 to check for this purpose at which cylinder, starting from the crank angle of the receipt of switchover request U following the expiration of the total delay crank angle $\alpha$ and a predefined value for safety interval $\beta$, the at least one exhaust valve is the next to open in the switched-on state or would be the next to open, though it is switched off. The associated cylinder is then selected such that its at least one intake or exhaust valve is provided to be the first to be switched off or switched on again following the receipt of switchover requirement U, provided that the selected cylinder is then capable or authorized. Thus, for selecting this cylinder, not only the total delay crank angle $\alpha$ is taken into account as in the above exemplary embodiment, but additionally a predefined safety interval $\beta$, as may be suitably applied on a test stand for example.

Taking into account safety interval $\beta$ provides as much as possible that the mechanical adjusting unit has switched at the latest by the start of phase AÖ' of the opened exhaust valve, i.e., without the mechanical adjusting unit being stressed by a seizing cam in the case of a camshaft control having phase adjustment.

In the example shown in FIG. 6, a switchover into half engine operation is performed by switching off the at least one intake or exhaust valve of second cylinder 10, of fourth cylinder 20, of sixth cylinder 30 and of eighth cylinder 40, and a switchover from half engine operation back into full engine operation is performed by switching on again second cylinder 10, fourth cylinder 20, sixth cylinder 30 and eighth cylinder 40. In this instance, first cylinder 5, third cylinder 15, fifth cylinder 25 and seventh cylinder 35 for example cannot be switched off with respect to their at least one intake or exhaust valve and thus are not authorized for half engine operation and thus remain switched on permanently.

The sequence of the described control function is terminated as soon as a, for example, modeled state feedback of switching unit 55 signals that all cylinders capable of and authorized for the half engine operation have switched their operating mode.

Switching unit 55 switches off or switches on again the at least one intake or exhaust valve of fourth cylinder 20, of sixth cylinder 30 and of eighth cylinder 40 according to the exemplary embodiment in FIG. 6 respectively to a crank angle shifted to retard by 180° crank angle, 360° crank angle or 540° crank angle from start crank angle $\delta$ of second cylinder 10.

What is claimed is:

1. A device for operating an internal combustion engine having multiple cylinders, comprising:

a switching device, which at least one of (a) switches off at least one of (a) at least one intake valve and (b) at least one exhaust valve of a cylinder and (b) switches on again at least one of (a) at least one switched-off intake valve and (b) at least one switched-off exhaust valve of the cylinder in at least one operating state of the internal combustion engine in response to a switchover request;

an ascertainment device, which with the receipt of the switchover request ascertains one of (a) a delay time and (b) a delay crank angle which is required for one of (a) switching off and (b) switching on again the at least one of (a) at least one intake valve and (b) at least one exhaust valve of one of the cylinders; and a selection device which, starting from the one of (a) the time and (b) the crank angle of the receipt of the switchover request and in accordance with one of (a) the ascertained delay time and (b) the ascertained delay crank angle, selects the cylinder having at least one exhaust valve following an expiration of one of (a) the delay time and (b) the delay crank angle, starting from the one of (a) the time and (b) the crank angle of the receipt of the switchover request, is one of (a) next to open in the switched-on state and (b) would be next to open, though it is switched off, the selection device ascertains the cylinder as the cylinder having at least one of (a) at least one intake valve and (b) at least one exhaust valve designated to be the first to be one of (a) switched off and (b) switched on again following the receipt of the switchover request.

2. A method for operating an internal combustion engine having multiple cylinders, comprising:

in response to a switchover request, one of (a) switching off at least one of (a) at least one intake valve and (b) at least one exhaust valve of a cylinder and (b) switching on again at least one of (a) at least one switched-off intake valve and (b) at least one switched-off exhaust valve of the cylinder in at least one operating state of the internal combustion engine;

with receipt of the switchover request, ascertaining one of (a) a delay time and (b) a delay crank angle required for one of (a) switching off and (b) switching on again the at least one of the at least one (a) intake valve and (b) exhaust valve of one of the cylinders;

starting from the one of (a) a time and (b) a crank angle of the receipt of the switchover request and in accordance with one of (a) the ascertained delay time and (b) the ascertained delay crank angle, selecting the cylinder having at least one exhaust valve following an expiration of the one of (a) the delay time and (b) the delay crank angle, starting from the one of (a) the time and (b) the crank angle of the receipt of the switchover request one of (a) that is next to open in the switched-on state and (b) that would be the next to open though it is switched off; and ascertaining the cylinder as the cylinder having at least one of (a) at least one intake valve and (b) at least one exhaust valve designated to be the first to be one of (a) switched off and (b) switched on again following the receipt of the switchover request.

3. The method according to claim 2, further comprising;

ascertaining a safety interval between an end of one of (a) the delay time and (b) the delay crank angle and one of (a) the time and (b) the crank angle for a potential opening of the at least one exhaust valve of one of the cylinders, of which the at least one of (a) the at least one intake valve and (b) the at least one exhaust valve is designated to be one of (a) switched off and (b) switched on again;

starting from the one of (a) the time and (b) the crank angle of the receipt of the switchover request and in accordance with one of (a) the ascertained delay time and (b) the ascertained delay crank angle and the ascertained safety interval, selecting the cylinder having at least one exhaust valve, following the expiration of the one of (a) the delay time and (b) the delay crank angle and of the safety interval starting from the one of (a) the time and (b) the crank angle of the receipt of the switchover request, that one of (a) is next to open in the switched-on state and (b) would be next to open, though it is switched-off; and ascertaining the cylinder as the cylinder having the at least one of (a) the least one intake valve and (b) the at least one exhaust valve designated to be the first to be one of (a) switched off and (b) switched on again following the receipt of the switchover request.

4. The method according to claim 2, wherein the selected cylinder is ascertained as the cylinder having at least one of (a) the at least one intake valve and (b) the at least one exhaust valve designated to be the first to be one of (a) switched off and (b) switched on again following the receipt of the switchover request only if it is one of (a) enabled for and (b) capable of having its at least one of (a) the at least one intake valve and (b) the at least one exhaust valve one of (a) switched off and (b) switched on again.

5. The method according to claim 2, wherein at least one of (a) the at least one intake valve and (b) the at least one exhaust valve is one of (a) switched off and (b) switched on again in multiple cylinders and, starting from the selected cylinder, at least one additional cylinder is designated to be one of (a) switched off and (b) switched on again which in a firing sequence is set apart by at least one even number from the selected cylinder.

6. The method according to claim 2, wherein, starting from the one of (a) the time and (b) crank angle of the receipt of the switchover request and in accordance with one of (a) one of (a) the ascertained delay time and (b) the ascertained delay crank angle ascertained next time and (b) crank angle for a potential opening of the at least one exhaust valve of the selected cylinder, its subsequent upper ignition dead center is ascertained and a check is performed as to which segment of a cylinder counter the upper ignition dead center is assigned;

and the selected cylinder is identified in accordance with the determined segment of the cylinder counter.

7. The method according to claim 2, wherein one of (a) the ascertained delay time and (b) the ascertained delay crank angle includes one of (a) a mechanical delay time and (b) a mechanical delay crank angle; and one of (a) the switching off and (b) the switching on again of the at least one of (a) the at least one intake valve and (b) the at least one exhaust valve of the selected cylinder is delayed by one of (a) a start time and (b) a start crank angle with respect to one of (a) the time and (b) the crank angle of the receipt of the switchover request in order to position the one of (a) the mechanical delay time and (b) the mechanical delay crank angle centrally in a switching window between one of (a) a time and (b) a crank angle for a potential opening of at least one intake valve and one of (a) a time and (b) a crank angle for a potential opening of at least one exhaust valve of the selected cylinder.

* * * * *